US007001050B2

(12) United States Patent
Beasley, Jr. et al.

(10) Patent No.: US 7,001,050 B2
(45) Date of Patent: Feb. 21, 2006

(54) LAMP DISPLAY TABLE

(75) Inventors: Robert E. Beasley, Jr., Germantown, TN (US); Robert J. Pape, Ponte Vedra Beach, FL (US); Jason D. Patz, Jacksonville, FL (US)

(73) Assignee: Hunter Fan Company, Memphis, TN (US)

( * ) Notice: Subject to any disclaimer, the term of this patent is extended or adjusted under 35 U.S.C. 154(b) by 107 days.

(21) Appl. No.: 10/751,547

(22) Filed: Jan. 5, 2004

(65) Prior Publication Data

US 2005/0146883 A1 Jul. 7, 2005

(51) Int. Cl.
*F21S 8/08* (2006.01)

(52) U.S. Cl. ..... 362/414; 362/384; 362/419; 362/428; 211/85.14

(58) Field of Classification Search ..... 362/414, 362/417, 418, 419, 384, 370, 322, 282, 285, 362/287, 427, 428; 211/85.14
See application file for complete search history.

(56) References Cited

U.S. PATENT DOCUMENTS 5,491,616 A * 2/1996 Reed ..... 362/35
5,996,819 A * 12/1999 Klein ..... 211/85.14
6,591,993 B1 * 7/2003 Humphrey ..... 211/85.14

* cited by examiner

*Primary Examiner*—John Anthony Ward
(74) *Attorney, Agent, or Firm*—Baker Donelson

(57) ABSTRACT

A lamp display table (10) is disclosed for use with several lamp bases LB and several lamp shades LS. The lamp display table (10) has a base (11) with an upright, vertical support (12), a lamp base platform (13) rotatably coupled to the vertical support (12, and lamp shade platform (14) in the form of a radial array of shade supports (15) rotatably coupled to the vertical support (12) and adapted to hold a lamp shade LS.

17 Claims, 2 Drawing Sheets

LAMP DISPLAY TABLE

TECHNICAL FIELD

This invention relates to display tables and specifically to display tables for lamps.

BACKGROUND OF THE INVENTION

Table lamps typically have a base, a harp mounted to the top of the base, a light socket, and a light shade mounted to the top of the harp. The base may be made in a vast number of different shapes, configurations, colors, textures, and materials. Similarly, the lamp shades may be made in a vast number of different shapes, colors, textures and materials.

In today's market, the lumps are often sold at the retail level with each base have a preselected shade. However, with more expensive or select lamps the lamp base is oftentimes sold separately from the lamp shade. Here, a customer may choose from a variety of lamp shades to be associated with the selected base. The customer typically selects the lamp shade by mounting several lamp shades to the base in succession until the desired shade is selected based on its appearance in conjunction with the base. In accomplishing this task, the customer must mount each lamp shade to the top of the harp then tighten a finial to secure the shade to the harp. This task of mounting several shades is tedious and time consuming. Furthermore, as lamp shades come in a variety of different sizes, one must oftentimes change the size of the harp so that the lamp shade is positioned a proper distance from the base. The constant changing of the harp is also tedious and time consuming for the customer.

Accordingly, it is seen that a need remains for a mechanism to allow different lamp shades to be displayed with a lamp base in a quick and efficient manner. It is to the provision of such therefore that the present invention is primarily directed.

SUMMARY OF THE INVENTION

In a preferred form of the invention, a lamp display table for displaying lamp bases and lamp shades comprises a support, a lamp base platform rotatably coupled to the support, and a lamp shade platform rotatably coupled to the support. The lamp base platform is configured to support at least one lamp base thereon. The lamp shade platform has a plurality of shade supports positioned above the lamp base platform. Each shade support is adapted to hold a lamp shade. With this construction, a person may rotate the lamp base platform or the lamp shade platform to align a lamp base positioned atop the lamp base platform with each of the overlying shade supports and thereby the lamp shades coupled thereto.

DETAILED DESCRIPTION

Figure 1:
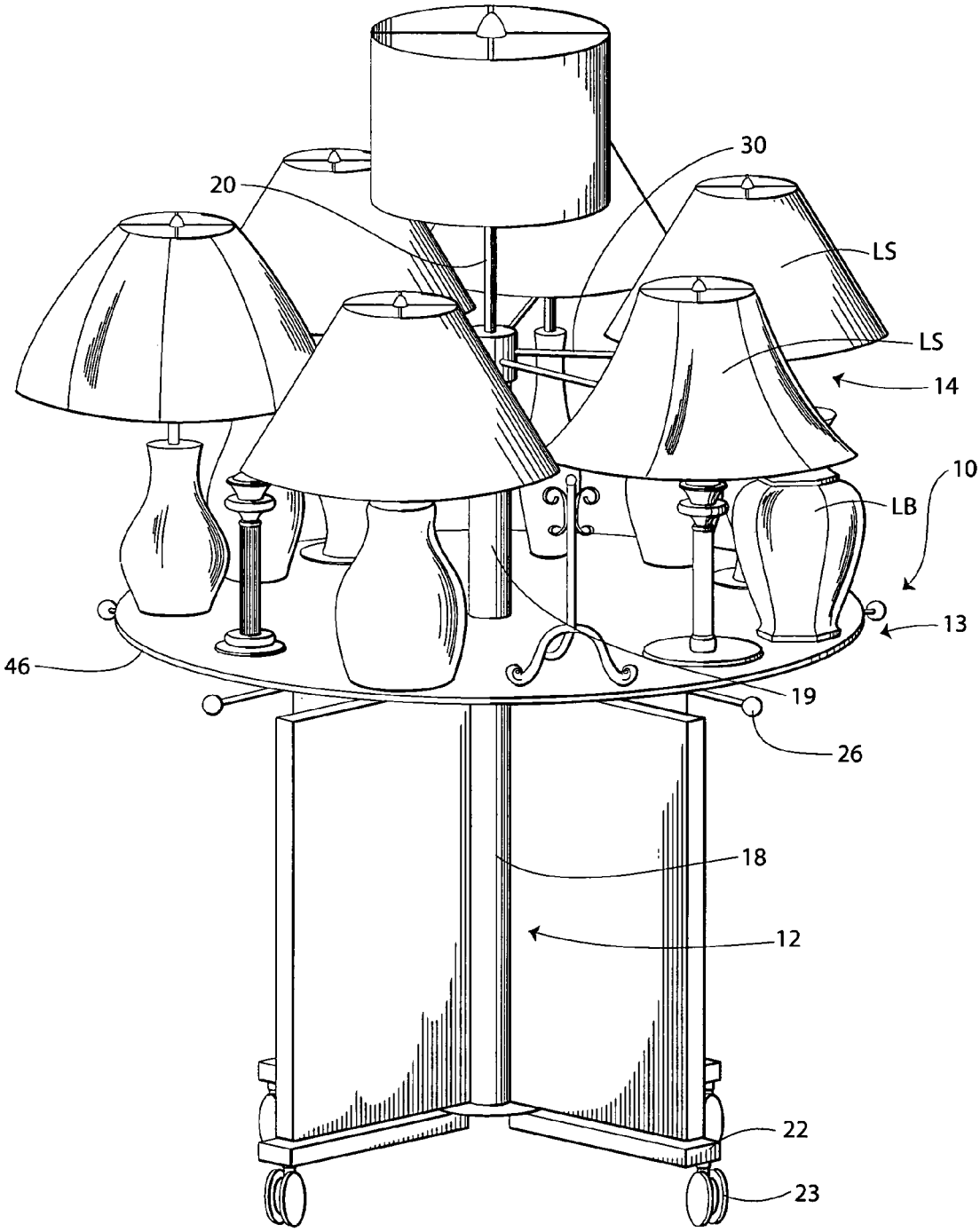
FIG. 1 is a perspective view of a lamp display table embodying principles of the invention in a preferred form.
Figure 3:
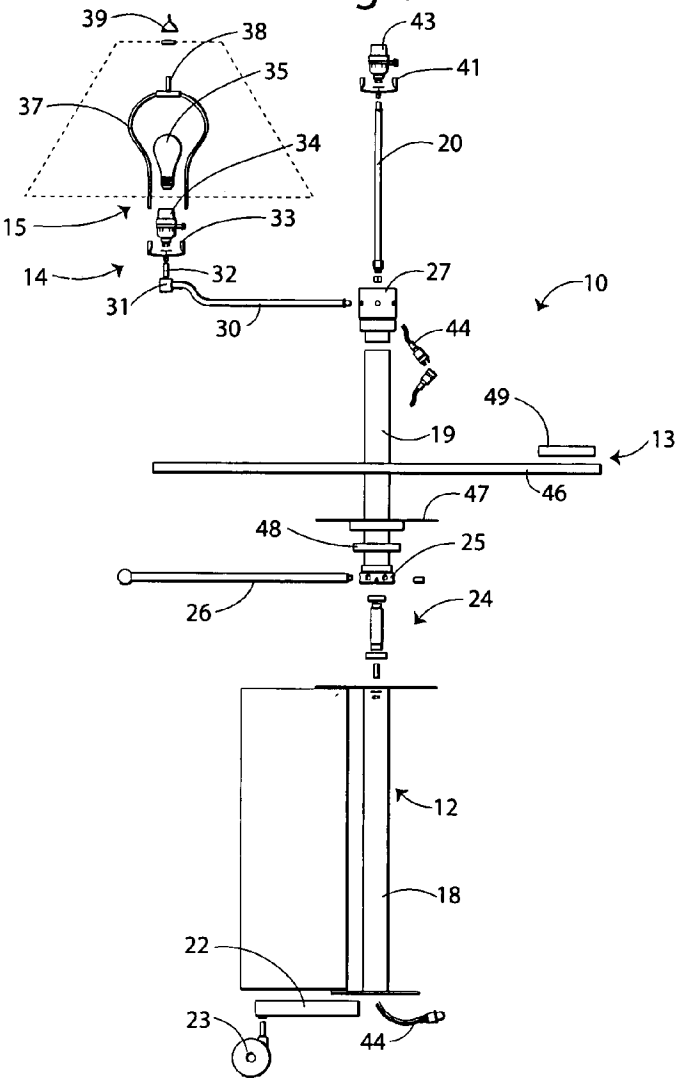
FIG. 3 is an exploded view of the lamp display table of FIG. 1.
Figure 2:
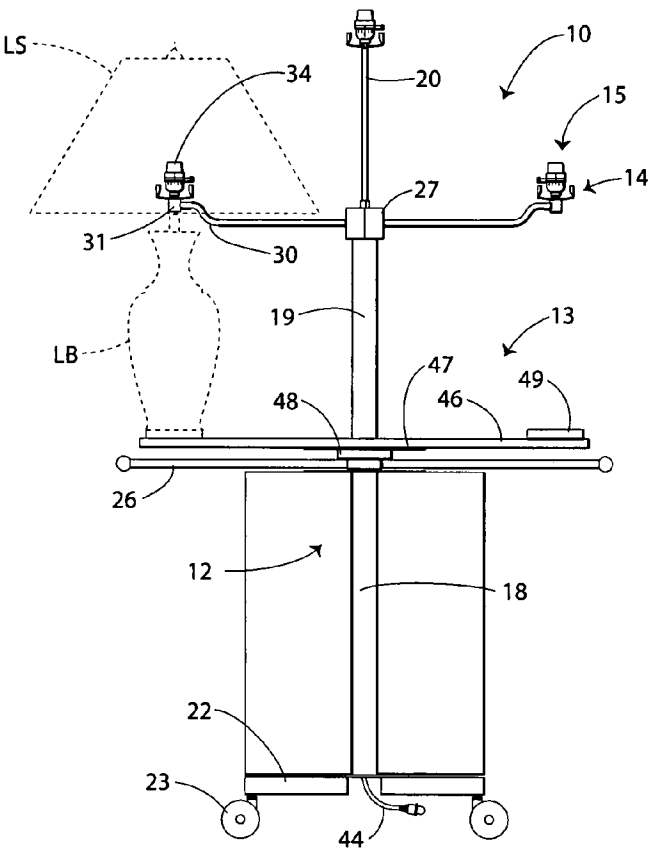
FIG. 2 is a side view of the lamp display table of FIG. 1.

With reference next to the drawings, there is shown a lamp display table 10 having an upright, vertical support 12, a lamp base platform 13 rotatably coupled to the vertical support 12, and lamp shade platform 14 rotatably coupled to the vertical support 12. The lamp shade platform is shown in the form of a radial array of shade supports 15

The vertical support 12 has a tubular lower portion 18, a tubular middle portion 19 rotatably coupled to the top of the lower portion 18, and a tubular upper portion 20 mounted to the top of the middle portion 19. The lower portion 18 has a plurality of legs 22 with wheeled castors 23 thereon.

The middle portion 19 is coupled to the lower portion 18 through a bearing assembly 24 which allows the middle portion 19 to be rotated relative to the lower portion 18. The middle portion 19 has a lower hub 25 to which is mounted a radial array of handles 26, and an upper hub 27 to which is coupled the shade support 15.

The shade support 15 include a radial array of tubular arms 30. Each arm 30 terminates with an internally threaded mount 31 having an externally threaded nipple or hollow member 32 threaded therein. The nipple 32 extends through a lamp harp base bracket 33 and is threaded into the bottom of a light bulb socket 34 housing a light bulb 35 therein. A harp 37, having a threaded top post 38 and finial 39, is coupled to the harp base bracket 33.

The upper portion 20 has a top end terminating with a lamp harp base bracket 41, an unshown harp, and light bulb socket 43. Light bulb sockets 34 and 43 are energized through a conventional electric line or cord 44 which extends through the middle of the tubular vertical support 12 and arms 30 and terminates with a conventional electric plug.

The lamp base platform 13 is journaled onto the middle portion 19 of the vertical support 12. The lamp base platform 13 includes a generally planar lamp base supporting member 46, a bearing plate 47, and a bearing 48 coupled to the supporting member 46 through the bearing plate 47. The bearing 48 enables the supporting member 46 to be rotated relative to both the middle portion 19 and the lower portion 18.

In use, one or more lamp bases LB are positioned upon the lamp base supporting member 46. Similarly, one or more lamp shades LS are positioned upon the lamp shade platform 14. Each lamp shade LS is coupled to one shade support 15 by placing the conventional central wire housing of the lamp shade LS onto the top post 38 and subsequently threading the finial 39 onto the top post 38 to secure the position of the lamp shade LS.

With the light sockets 34 energized the light bulbs 35 are illuminated to replicate the light from light bulbs associated with the selected lamp shades LS and lamp bases LB. However, as each lamp shade LS is mounted independently of any lamp base LB a buyer may quickly and easily mix and match any lamp shade LS to any lamp base LB by simply aligning them together through the rotation of either the lamp base platform 13 or the lamp shade platform 14. As such, a customer can compare any of several combinations of lamp bases and lamp shades over and over again by simply rotating the platforms back and forth between any of several aligned positions. Obviously, this is accomplished without the customer having to constantly remove and replace the lamp shade each time a base and shade comparison is made by the customer.

The lamp base platform 13 is rotated by simply grasping the peripheral edge of the lamp base supporting member 46 and manually rotating it. The lamp base supporting member 46 is allowed to rotate about the middle portion 19 through bearing 48. Similarly, the lamp shade platform 14 is rotated by grasping one of the handles 26 and manually rotating it about the vertical support 12. The lamp shade platform 14 is allowed to rotate through bearing assembly 24. Obviously, one could rotate the lamp shade platform by pushing upon one of the lamp shades mounted thereto. However, the handles 26 are provided to discourage this action due to the resulting damage or soiling of the lamp shades LS which may occur through such contact.

It should be understood that the upper portion 20 and associated light assembly are optional as they are provided to enhance the aesthetics of the display table and to provide the ability to display company signage.

It should also be understood that the display table 10 may also include spacers 49 adapted to be placed upon the lamp base supporting member 46. These spacers 49 are provided to enable lamp bases LB of different heights to have the same relative height. For example, a first lamp base having a nineteen-inch height may be placed adjacent to a second lamp base having an eighteen-inch height with a one inch spacer positioned beneath the second lamp base. As a result, both lamp bases have the same height from the top surface of the lamp base supporting member 46 so that the lamp shades coupled to the lamp shade platform may be aligned properly with both lamp bases even though they are actually of different heights.

It should also be understood that even though the preferred embodiment shows that both the lamp base platform 13 and the lamp shade platform 14 rotate, the present invention may also include a display table having either platform rotate without requiring the other platform to rotate.

It thus is seen that a lamp display table is now provided which enables one to quickly and efficiently align several lamp shades with several lamp bases. While this invention has been described in detail with particular references to the preferred embodiments thereof, it should be understood that many modifications, additions and deletions, in addition to those expressly recited, may be made thereto without departure from the spirit and scope of the invention as set forth in the following claims.

What is claimed is:

1. A lamp display table for displaying lamp bases and lamp shades, the lamp display table comprising:

a support;

a lamp base platform rotatably coupled to said support, said lamp base platform being configured to support at least one lamp base thereon;

a lamp shade platform coupled to said support, said lamp shade platform having a plurality of shade supports positioned above said lamp base platform, each said shade support being adapted to hold a lamp shade, whereby a person may rotate the lamp base platform relative to the support to align a lamp base positioned atop the lamp base platform with each of the overlying shade supports and thereby the lamp shades coupled thereto.

2. The lamp display table of claim 1 wherein said lamp shade platform rotates relative to said support, whereby both the lamp base platform and the lamp shade platform may be rotated relative to each other and relative to the support.

3. The lamp display table of claim 1 wherein said lamp shade platform comprises a plurality of arms.

4. The lamp display table of claim 1 wherein each said shade support includes a light source.

5. The lamp display table of claim 2 further comprising at least one handle coupled to said lamp shade platform for rotating said lamp shade platform.

6. The lamp display table of claim 5 wherein said handle is positioned below said lamp base platform.

7. A lamp display table for displaying lamp bases and lamp shades, the lamp display table comprising:

a support;

a lamp base platform coupled to said support, said lamp base platform being configured to support at least one lamp base thereon;

a lamp shade platform rotatably coupled to said support, said lamp shade platform having a plurality of shade supports positioned above said lamp base platform, each shade support being adapted to hold a lamp shade, whereby a person may rotate the lamp shade platform relative to the support to align a lamp shade coupled to a shade support with a lamp base positioned upon the lamp base platform.

8. The lamp display table of claim 7 wherein said lamp base platform rotates relative to said support, whereby both the lamp base platform and the lamp shade platform may be rotated relative to each other and relative to the support.

9. The lamp display table of claim 7 wherein said lamp shade platform comprises a plurality of arms.

10. The lamp display table of claim 7 wherein each said shade support includes a light source.

11. The lamp display table of claim 7 further comprising at least one handle coupled to said lamp shade platform for rotating said lamp shade platform.

12. The lamp display table of claim 11 wherein said handle is positioned below said lamp base platform.

13. A lamp display table for displaying lamp bases and lamp shades, the lamp display table comprising:

a support;

a lamp base platform rotatably coupled to said support, said lamp base platform being configured to support at least one lamp base thereon;

a lamp shade platform rotatably coupled to said support, said lamp shade platform having a plurality of shade supports positioned above said lamp base platform, each shade support being adapted to hold a lamp shade, whereby a person may rotate the lamp base platform or the lamp shade platform to align a lamp base positioned atop the lamp base platform with each of the overlying shade supports and thereby the lamp shades coupled thereto.

14. The lamp display table of claim 1 wherein said lamp shade platform comprises a plurality of arms.

15. The lamp display table of claim 13 wherein each said shade support includes a light source.

16. The lamp display table of claim 13 further comprising at least one handle coupled to said lamp shade platform for rotating said lamp shade platform.

17. The lamp display table of claim 16 wherein said handle is positioned below said lamp base platform.

* * * * *